US010748701B2

(12) United States Patent
Yen et al.

(10) Patent No.: US 10,748,701 B2
(45) Date of Patent: Aug. 18, 2020

(54) INDUCTOR DEVICE

(71) Applicant: Realtek Semiconductor Corporation, Hsinchu (TW)

(72) Inventors: Hsiao-Tsung Yen, Hsinchu (TW); Cheng-Wei Luo, Hsinchu (TW); Yuh-Sheng Jean, Hsinchu (TW); Ta-Hsun Yeh, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 141 days.

(21) Appl. No.: 15/975,753

(22) Filed: May 9, 2018

(65) Prior Publication Data

US 2018/0330872 A1 Nov. 15, 2018

(30) Foreign Application Priority Data

May 11, 2017 (TW) ..... 106115648 A

(51) Int. Cl.

| | |
|---|---|
| ***H01F 27/28*** | (2006.01) |
| ***H01F 27/34*** | (2006.01) |
| ***H01F 27/29*** | (2006.01) |
| ***H01F 17/00*** | (2006.01) |

(52) U.S. Cl.

CPC ..... *H01F 27/34* (2013.01); *H01F 17/0006* (2013.01); *H01F 27/2823* (2013.01); *H01F 27/29* (2013.01); *H01F 2017/004* (2013.01)

(58) Field of Classification Search

CPC ..... H01F 27/34; H01F 27/2823; H01F 27/29; H01F 27/2804; H01F 17/0006; H01F 2017/004; H01F 2017/0073; H01F 5/003

USPC ..... 336/220, 223, 192, 225, 226, 222

See application file for complete search history.

(56) References Cited

U.S. PATENT DOCUMENTS

| | | | | |
|---|---|---|---|---|
| 4,816,784 | A * | 3/1989 | Rabjohn | H01F 27/2804 333/24 R |
| 5,477,204 | A * | 12/1995 | Li | H01F 17/0006 336/200 |
| 8,183,971 | B2 | 5/2012 | Le Guillou et al. | |
| 8,890,519 | B2 * | 11/2014 | Klein | G01R 33/0052 324/258 |
| 2003/0071706 | A1 * | 4/2003 | Christensen | H01L 27/08 336/200 |
| 2005/0104706 | A1 * | 5/2005 | Chou | H01F 27/2804 336/200 |
| 2006/0077028 | A1 * | 4/2006 | Huang | H01F 17/0006 336/223 |
| 2009/0066457 | A1 * | 3/2009 | Uchida | H01F 27/2804 336/188 |

(Continued)

*Primary Examiner* — Mang Tin Bik Lian

(74) *Attorney, Agent, or Firm* — CKC & Partners Co., LLC

(57) ABSTRACT

An inductor device includes a first and a second inductor unit. The first inductor unit includes a first and a second wire. The first wire is winded to form circles. The second wire is winded with the first wire to form circles. The first and/or the second wire are winded in an interlaced manner at a first terminal, a second terminal, a first side, and a second side. The second inductor unit includes a third and a fourth wire. The third wire is winded to form circles. The fourth wire is winded with the third wire to form circles. The third and/or the fourth wire are winded in an interlaced manner at a third terminal, a fourth terminal, a third side, and a fourth side. The first wired is coupled to the fourth wired, and the second wired is coupled to the third wired.

20 Claims, 6 Drawing Sheets

(56) References Cited

U.S. PATENT DOCUMENTS

| | | | | |
|---|---|---|---|---|
| 2009/0261935 | A1* | 10/2009 | Hisamitsu | H01F 27/346 336/200 |
| 2010/0164667 | A1* | 7/2010 | Ho-Hsiang | H01F 27/34 336/137 |
| 2011/0148733 | A1* | 6/2011 | Fahs | H01F 17/0006 343/859 |
| 2012/0274434 | A1* | 11/2012 | Lim | H01F 19/04 336/200 |
| 2013/0265132 | A1* | 10/2013 | Huang | H01F 27/2804 336/192 |
| 2015/0170824 | A1* | 6/2015 | Tesson | H01F 27/2804 336/190 |
| 2017/0098500 | A1 | 4/2017 | Yen et al. | |

* cited by examiner

INDUCTOR DEVICE

RELATED APPLICATIONS

This application claims priority to Taiwan Application Serial Number 106115648, filed May 11, 2017, which is herein incorporated by reference.

BACKGROUND OF THE INVENTION

Field of Invention

The present disclosure relates to basic electronical elements. More particularly, the present disclosure relates to an inductor device.

Description of Related Art

Performance for neutralizing coupling of a conventional 8-shaped transformer is usually affected because the structure of the 8-shaped transformer is not symmetrical. Specifically, if the 8-shaped transformer is formed of two circles having structures that are not symmetrical, magnetic field produced from each of the circuits of the two circles would be shifted. For example, if the structures of the two circles are not symmetrical, the magnetic field would be shifted to one side of the two circles. Therefore, the efficiency of the 8-shaped transformer is thereby affected.

SUMMARY OF THE INVENTION

One aspect of the present disclosure is directed to an inductor device. The inductor device comprises a first inductor unit and a second inductor unit. The first inductor unit comprises a first terminal, a second terminal, a first wire and a second wire. The first terminal and the second terminal are respectively disposed at two opposite sides of the first inductor unit, wherein the first inductor unit comprises a first side and a second side located at two opposite sides of a first central connecting line, wherein the first central connecting line is between the first terminal and the second terminal. The first wire is winded to form a plurality of circles. The second wire is winded correspondingly to the first wire to form a plurality of circles, wherein the first wire and/or the second wire are winded in an interlaced manner at the first terminal, the second terminal, the first side, and the second side respectively. The second inductor unit comprises a third terminal, a fourth terminal, a third wire, and a fourth wire. The third terminal and the fourth terminal are respectively disposed at two opposite sides of the second inductor unit, wherein the second inductor unit comprises a third side and a fourth side located at two opposite sides of a second central connecting line, wherein the second central connecting line is between the third terminal and the fourth terminal. The third wire is winded to form a plurality of circles. The fourth wire is winded correspondingly to the third wire to form a plurality of circles, wherein the third wire and/or the fourth wire are winded in an interlaced manner at the third terminal, the fourth terminal, the third side, and the fourth side respectively. The first wire of the first inductor unit is coupled to the fourth wire of the second inductor unit, and the second wire of the first inductor unit is coupled to the third wire of the second inductor unit.

In view of the foregoing, embodiments of the present disclosure provide an inductor device. Since structures of two inductor units of the inductor device are symmetrical, the problem of performance of the conventional 8-shaped transformer being affected because the structure of the 8-shaped transformer is not symmetrical can be solved.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
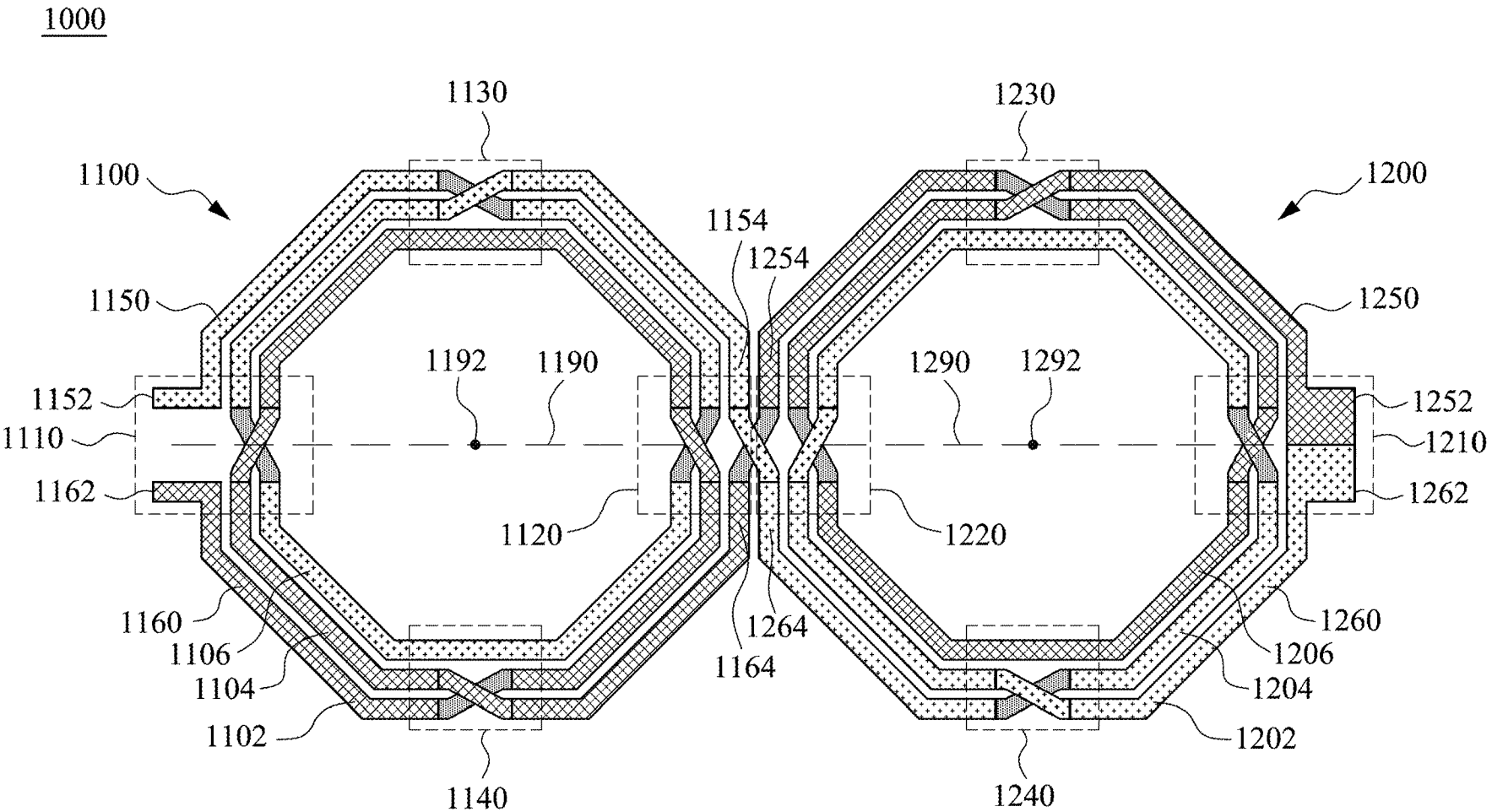
FIG. 1 is a schematic diagram of an inductor device according to some embodiments of the present disclosure.

FIG. 1 is a schematic diagram of an inductor device 1000 according to some embodiments of the present disclosure. As shown in figure, the inductor device 1000 includes a first inductor unit 1100 and a second inductor unit 1200. The foregoing first inductor unit 1100 includes a first terminal 1110, a second terminal 1120, a first side 1130, a second side 1140, a first wire 1150 and a second wire 1160. Besides, the foregoing second inductor unit 1200 includes a third terminal 1210, a fourth terminal 1220, a third side 1230, a fourth side 1240, a third wire 1250 and a fourth wire 1260.

With respective to structure, reference is now made to the first inductor unit 1100. The first terminal 1110 and the second terminal 1120 of the first inductor unit 1100 are respectively disposed at two opposite sides (i.e., the left side and the right side as shown in the figure) of the first inductor unit 1100. Besides, the first inductor unit 1100 includes a first side 1130 and a second side 1140 (i.e., the upper side and the lower side as shown in the figure) located at two opposite sides of a first central connecting line 1190, wherein the first central connecting line 1190 is between the first terminal 1110 and the second terminal 1120. The first wire 1150 is winded to form a plurality of circles, and the second wire 1160 is winded correspondingly to the first wire 1150 to form a plurality of circles. As shown in figure, the first wire 1150 and/or the second wire 1160 are winded in an interlaced manner at the first terminal 1110, the second terminal 1120, the first side 1130, and the second side 1140 respectively.

Furthermore, reference is now made to the second inductor unit 1200. The third terminal 1210 and the fourth terminal 1220 of the second inductor unit 1200 are respectively disposed at two opposite sides (i.e., the right side and the left side as shown in the figure) of the second inductor unit 1200. Besides, the second inductor unit 1200 includes a third side 1230 and a fourth side 1240 located at two opposite sides (i.e., the upper side and the lower side as shown in the figure) of a second central connecting line 1290, wherein the second central connecting line 1290 is between the third terminal 1210 and the fourth terminal 1220. The third wire 1250 is winded to form a plurality of circles, and the fourth wire 1260 is winded correspondingly to the third wire 1250 to form a plurality of circles. As shown in figure, the third wire 1250 and/or the fourth wire 1260 are winded in an interlaced manner at the third terminal 1210, the fourth terminal 1220, the third side 1230, and the fourth side 1240 respectively. Moreover, the first wire 1150 of the first inductor unit 1100 is coupled to the fourth wire 1260 of the second inductor unit 1200, and the second wire 1160 of the first inductor unit 1100 is coupled to the third wire 1250 of the second inductor unit 1200.

As can be seen in the figure, the entire structure of the present disclosure is symmetrical. Specifically, the winded manner of the wires 1150, 1160 of the first inductor unit 1100 and the winded manner of the wires 1250, 1260 of the second inductor unit 1200 are extremely symmetrical. As shown in figure, the interlaced locations of the wires 1150, 1160 of the first inductor unit 1100 and the interlaced locations of the wires 1250, 1260 of the second inductor unit 1200 are exactly the same. Therefore, the magnetic field will not be shifted among the inductor units 1100, 1200 so as to enhance the efficiency of the inductor device 1000. Furthermore, the inductor device 1000 has two inductor units 1100, 1200, and therefore, if the two inductor units 1100, 1200 receive signals and generate magnetic field respectively during operation, the magnetic fields will be offset for enhancing the efficiency of the inductor device 1000.

In one embodiment, the foregoing first wire 1150 includes a first end 1152 and a second end 1154, and the second wire 1160 includes a first end 1162 and a second end 1164. With respective to structure, the first ends 1152, 1162 of the first wire 1150 and the second wire 1160 are located at the first terminal 1110 of the first inductor unit 1100. The second ends 1154, 1164 of the first wire 1150 and the second wire 1160 are located at the second terminal 1120 of the first inductor unit 1100. Besides, the foregoing third wire 1250 includes a first end 1252 and a second end 1254, and the fourth wire 1260 includes a first end 1262 and a second end 1264. With respective to structure, the first ends 1252, 1262 of the third wire 1250 and the fourth wire 1260 are located at the third terminal 1210 of the second inductor unit 1200, and the second ends 1254, 1264 of the third wire 1250 and the fourth wire 1260 are located at the fourth terminal 1220 of the second inductor unit 1200.

In another embodiment, the first inductor unit 1100 includes a first circle 1102, a second circle 1104 and a third circle 1106. The first wire 1150 is winded from the first end 1152, based on a first center point 1192 as a center, to the first side 1130 along the first circle 1102 and then winded in an interlaced manner into the second circle 1104. Next, the first wire 1150 is winded to the second terminal 1120 along the second circle 1104 and then winded in an interlaced manner into the third circle 1106. Besides, the first wire 1150 is winded to the first terminal 1110 along the third circle 1106 and then winded in an interlaced manner to the second circle 1104. Next, the first wire 1150 is winded to the first side 1130 along the second circle 1104 and then winded in an interlaced manner into the first circle 1102 so as to couple to the second inductor unit 1200, and the detailed connection will be described as below.

Correspondingly, the second wire 1160 is winded from the first end 1162, based on the first center point 1192 as a center, to the second side 1140 along the first circle 1102 and then winded in an interlaced manner into the second circle 1104. Next, the second wire 1160 is winded to the second terminal 1120 along the second circle 1104 and then winded in an interlaced manner into the third circle 1106. Besides, the second wire 1160 is winded to the first terminal 1110 along the third circle 1106 and then winded in an interlaced manner to the second circle 1104. Next, the second wire 1160 is winded to the second side 1140 along the second circle 1104 and then winded in an interlaced manner into the first circle 1102 so as to couple to the second inductor unit 1200, and the detailed connection will be described as below.

In still another embodiment, the second inductor unit 1200 includes a first circle 1202, a second circle 1204 and a third circle 1206. The third wire 1250 is winded from the first end 1252, based on a second center point 1292 as a center, to the third side 1230 along the first circle 1202 and then winded in an interlaced manner into the second circle 1204. Next, the third wire 1250 is winded to the fourth terminal 1220 along the second circle 1204 and then winded in an interlaced manner into the third circle 1206. Besides, the third wire 1250 is winded to the third terminal 1210 along the third circle 1206 continuously and then winded in an interlaced manner to the second circle 1204. Next, the third wire 1250 is winded to the third side 1230 along the second circle 1204 and winded in an interlaced manner into the first circle 1202 so as to couple to the second wire 1160 of the first inductor 1100.

Correspondingly, the fourth wire 1260 is winded from the first end 1262, based on the second center point 1292 as a center, to the fourth side 1240 along the first circle 1202 and then winded in an interlaced manner into the second circle 1204. Next, the fourth wire 1260 is winded to the fourth terminal 1220 along the second circle 1204 and then winded in an interlaced manner into the third circle 1206. Besides, the fourth wire 1260 is winded to the third terminal 1210 along the third circle 1206 and then winded in an interlaced manner to the second circle 1204. Next, the fourth wire 1260 is winded to the fourth side 1240 along the second circle 1204 and then winded in an interlaced manner into the first circle 1202 so as to couple to the first wire 1150 of the first inductor 1100.

As shown in the figure, the first wire 1150 of the first inductor 1100 is winded in an interlaced manner at the first side 1130 by itself. Besides, the first wire 1150 is winded in an interlaced manner with the second wire 1160 at the first terminal 1110 and the second terminal 1120, and the second wire 1160 is winded in an interlaced manner at the second side 1140 by itself. Furthermore, the third wire 1250 of the second inductor 1200 is winded in an interlaced manner at the third side 1230 by itself. Besides, the third wire 1250 is wined in an interlaced manner with the fourth wire 1260 at the third terminal 1210 and the fourth terminal 1220, and the fourth wire 1260 is winded in an interlaced manner at the fourth side 1240 by itself. In one embodiment, the first circle 1102, the second circle 1104 and the third circle 1106 of the first inductor 1100 are disposed from outside to inside in sequence. Besides, the first circle 1202, the second circle 1204 and the third circle 1206 of the second inductor 1200 are disposed from outside to inside in sequence. In another embodiment, the shapes of the first inductor 1100 and the second inductor 1200 can be octagon. However, the present disclosure is not intended to be limited to the embodiment in FIG. 1, the embodiment in FIG. 1 is merely an exemplary embodiment for illustration purpose.

Figure 2:
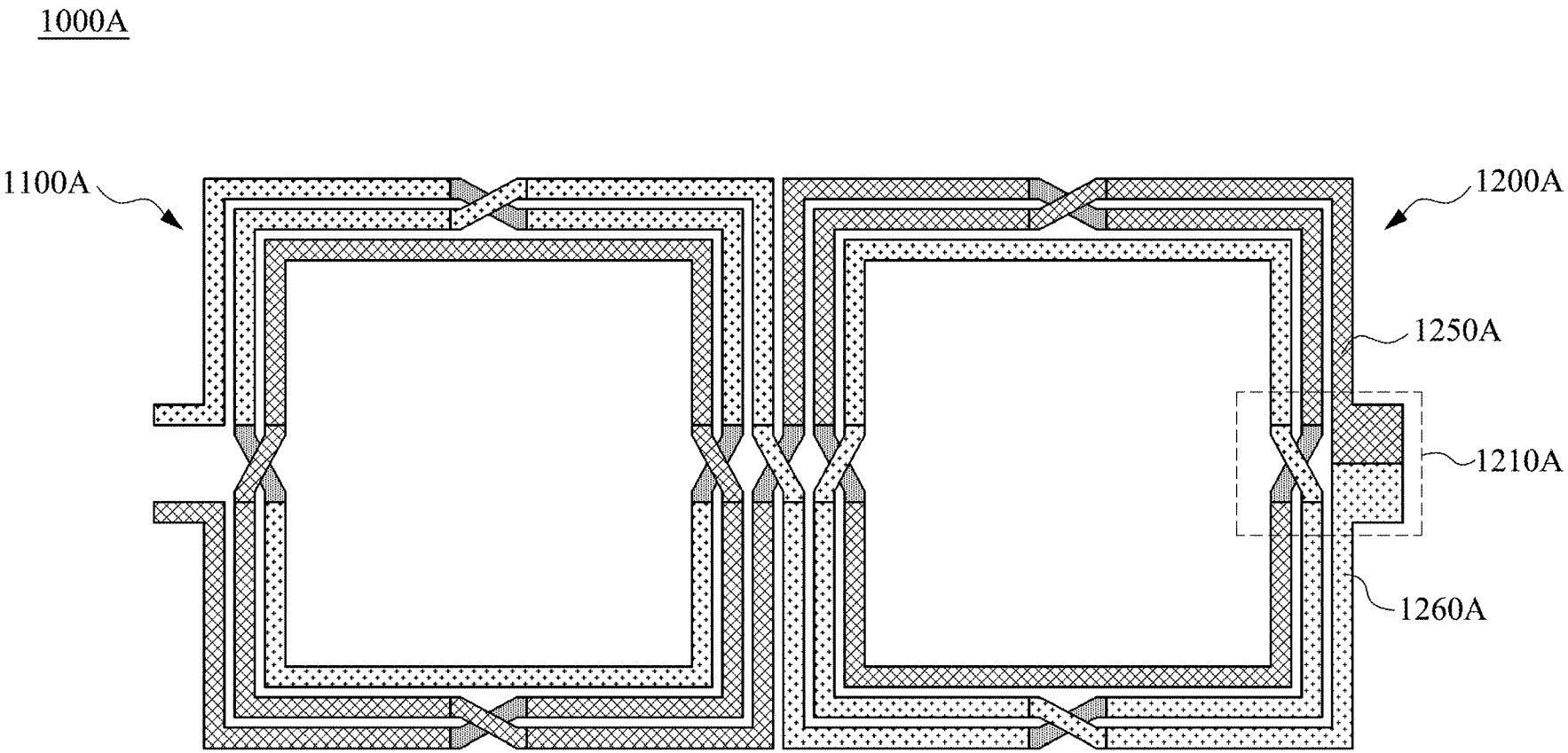
FIG. 2 is a schematic diagram of an inductor device according to some embodiments of the present disclosure.

FIG. 2 is a schematic diagram of an inductor device 1000A according to some embodiments of the present disclosure. In contrast to the inductor units 1100, 1200 in FIG. 1 whose shapes are octagon, the shapes of the inductor units 1100A, 1200A in FIG. 2 are quadrangle. It is noted that, except for shapes of the inductor units 1100, 1200 in FIG. 1 and the inductor units 1100A, 1200A in FIG. 2 being different, the structures of the inductor units 1100, 1200 in FIG. 1 and the structures of the inductor units 1100A, 1200A in FIG. 2 are similar. For the sake of brevity of the specification, the detailed description thereof will be omitted herein. It is noted that the advantage of the structure in FIG. 2 is that the shape of the inductor units 1100A, 1200A can be quadrangle when the space utilization of the entire system is the first consideration so as to fully use the space.

Figure 3:
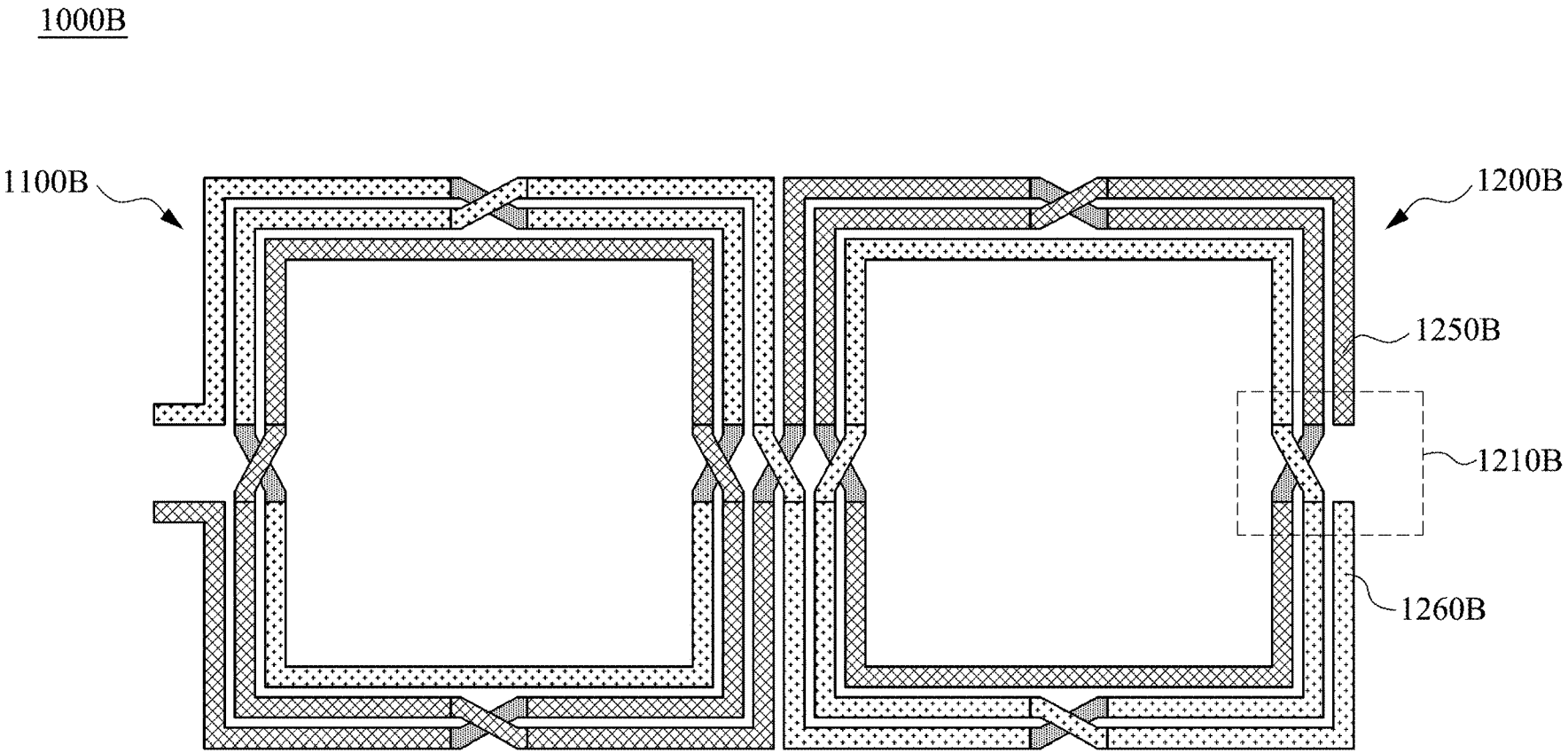
FIG. 3 is a schematic diagram of an inductor device according to some embodiments of the present disclosure.

FIG. 3 is a schematic diagram of an inductor device 1000B according to some embodiments of the present disclosure. Compared with the inductor unit 1200A in FIG. 2, the third wire 1250B and the fourth wire 1260B of the inductor unit 1200B in FIG. 3 are not coupled at the third terminal 1210B (the third wire 1250A and fourth wire 1260A of the inductor unit 1200A in FIG. 2 are coupled at the third terminal 1210A). Except for the foregoing difference, the structure of the inductor units 1100B, 1200B in FIG. 3 and the structure of the inductor units 1100A, 1200A in FIG. 2 are similar. For the sake of brevity of the specification, the detailed description thereof will be omitted herein.

Figure 4:
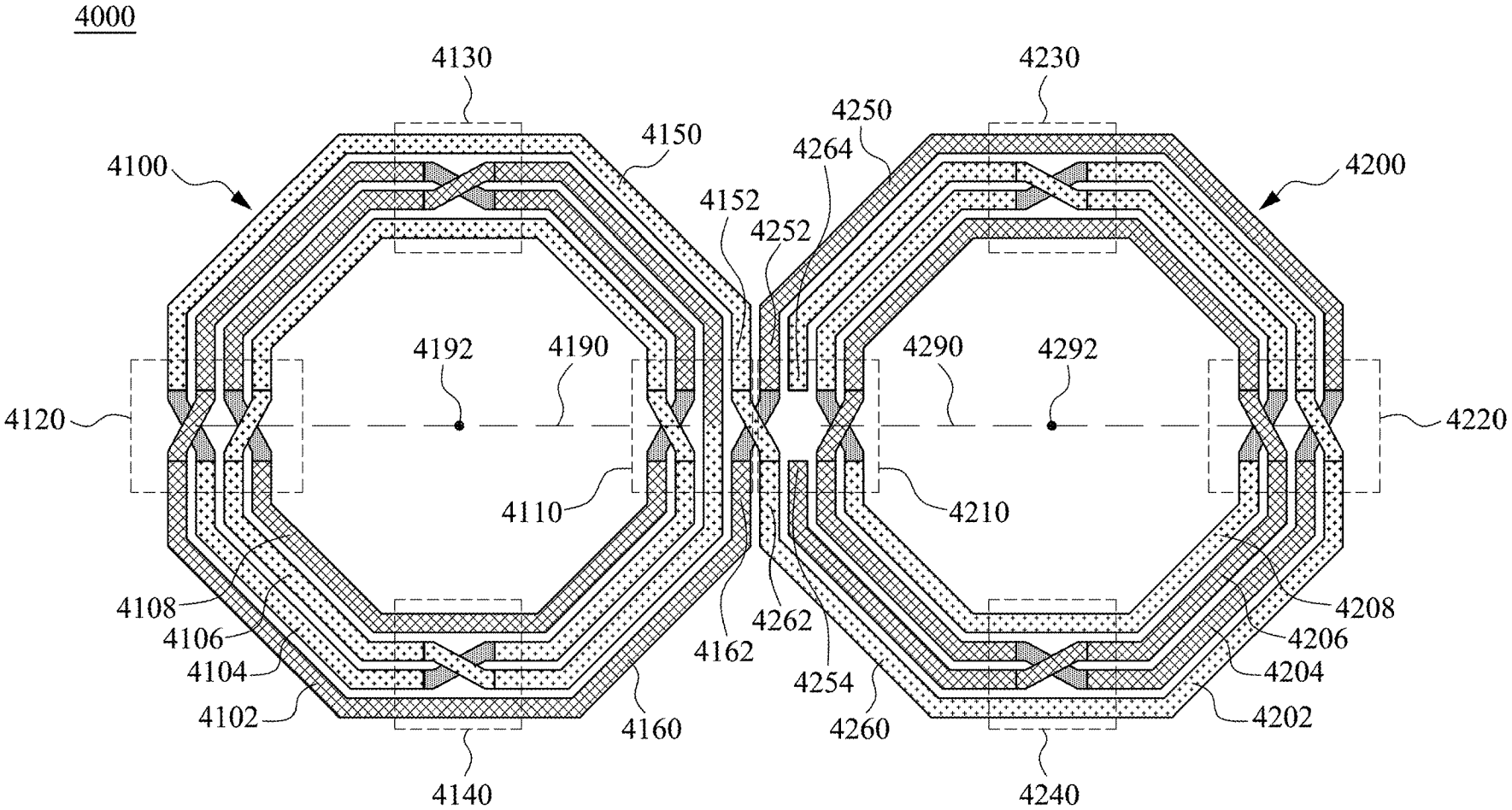
FIG. 4 is a schematic diagram of an inductor device according to some embodiments of the present disclosure.

FIG. 4 is a schematic diagram of an inductor device 4000 according to some embodiments of the present disclosure. As shown in figure, the first inductor unit 4100 includes a first circle 4102, a second circle 4104, a third circle 4106 and a fourth circle 4108. The first wire 4150 is winded from the first end 4152, based on a first center point 4192 as a center, to the second terminal 4120 along the first circle 4102 and then winded in an interlaced manner into the second circle 4104. Next, the first wire 4150 is winded to the second side 4140 along the second circle 4104 and then winded in an interlaced manner into the third circle 4106. Besides, the first wire 4150 is winded to the first terminal 4110 along the third circle 4106 and then winded in an interlaced manner into the fourth circle 4108. Besides, the first wire 4150 is wined to the second terminal 4120 along the fourth circle 4108 and then winded in an interlaced manner into the third circle 4106. Next, the first wire 4150 is winded to the second side 4140 along the third circle 4106 and then winded in an interlaced manner into the second circle 4104.

Correspondingly, the second wire 4160 is winded from the first end 4162 to the second terminal 4120 along the first circle 4102 and then winded in an interlaced manner into the second circle 4104. Next, the second wire 4160 is winded to the first side 4130 along the second circle 4104 and then winded in an interlaced manner into the third circle 4106. Afterwards, the second wire 4160 is winded to the first terminal 4110 along the third circle 4106 and then winded in an interlaced manner into the fourth circle 4108. Besides, the second wire 4160 is wined to the second terminal 4120 along the fourth circle 4108 and then winded in an interlaced manner into the third circle 4106. Next, the second wire 4160 is winded to the first side 4130 along the third circle 4106 and then winded in an interlaced manner into the second circle 4104.

In another embodiment, the second inductor unit 4200 includes a first circle 4202, a second circle 4204, a third circle 4206 and a fourth circle 4208. The third wire 4250 is winded from the first end 4252, based on a second center point 4292 as a center, to the fourth terminal 4220 along the first circle 4202 and then winded in an interlaced manner into the second circle 4204. Next, the third wire 4250 is winded to the fourth side 4240 along the second circle 4204 and then winded in an interlaced manner into the third circle 4206. Afterwards, the third wire 4250 is winded to the third terminal 4210 along the third circle 4206 and then winded in an interlaced manner into the fourth circle 4208. Besides, the third wire 4250 is wined to the fourth terminal 4220 along the fourth circle 4208 and then wined in an interlaced manner into the third circle 4206. Next, the third wire 4250 is winded to the fourth side 4240 along the third circle 4206 and then winded in an interlaced manner into the second circle 4204. Finally, the third wire 4250 is ended at the second end 4254.

Correspondingly, the fourth wire 4260 is winded from the first end 4262 to the fourth terminal 4220 along the first circle 4202 and then winded in an interlaced manner into the second circle 4204. Next, the fourth wire 4260 is winded to the third side 4230 along the second circle 4204 and then winded in an interlaced manner into the third circle 4206. Afterwards, the fourth wire 4260 is winded to the third terminal 4210 along the third circle 4206 and then winded in an interlaced manner into the fourth circle 4208. Besides, the fourth wire 4260 is wined to the fourth terminal 4220 along the fourth circle 4208 and then wined in an interlaced manner into the third circle 4206. Next, the fourth wire 4260 is winded to the third side 4230 along the third circle 4206 and then winded in an interlaced manner into the second circle 4204. Finally, the fourth wire 4260 is ended at the second end 4264.

As shown in figure, the first wire 4150 is winded in an interlaced manner at the second side 4140 by itself. The first wire 4150 is winded in an interlaced manner with the second wire 4160 at the first terminal 4110 and the second terminal 4120. The second wire 4160 is winded in an interlaced manner at the first side 4130 by itself. Besides, the third wire 4250 is winded in an interlaced manner at the fourth side 4240 by itself. The third wire 4250 is wined in an interlaced manner with the fourth wire 4260 at the third terminal 4210 and the fourth terminal 4220. The fourth wire 4260 is winded in an interlaced manner at the third side 4230 by itself. In one embodiment, the first end 4162 of the second wire 4160 is coupled to the first end 4252 of the third wire 4250, and the first end 4152 of the first wire 4150 is coupled to the first end 4262 of the fourth wire 4260 in an interlaced manner at the first terminal 4110 and third terminal 4210. In another embodiment, the first circle 4102, the second circle 4104, the third circle 4106 and the fourth circle 4108 of the first inductor unit 4100 are disposed from outside to inside in sequence. Besides, the first circle 4202, the second circle 4204, the third circle 4206 and the fourth circle 4208 of the second inductor unit 4200 are disposed from outside to inside in sequence. However, the present disclosure is not intended to be limited to the embodiment in FIG. 4, the embodiment in FIG. 4 is merely an exemplary embodiment for illustration purpose.

Figure 5:
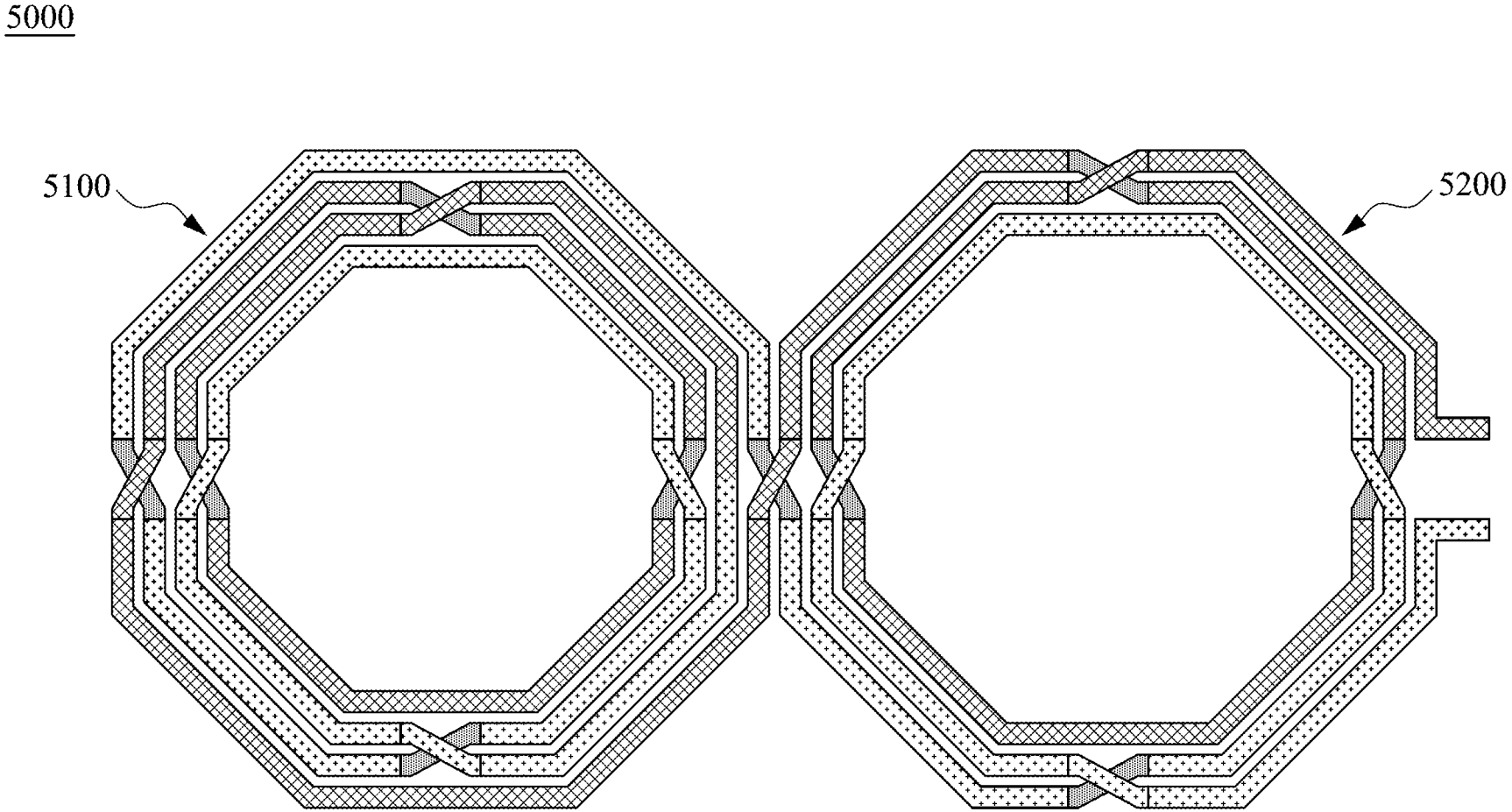
FIG. 5 is a schematic diagram of an inductor device according to some embodiments of the present disclosure.

FIG. 5 is a schematic diagram of an inductor device 5000 according to some embodiments of the present disclosure. As shown in figure, the inductor device 5000 includes a first inductor unit 5100 and a second inductor unit 5200. It is noted that, the structure of the first inductor unit 5100 in FIG. 5 is similar to the structure of the first inductor unit 4100 in FIG. 4. Besides, the structure of the second inductor unit 5200 in FIG. 5 is similar to the structure of the second inductor unit 1200 in FIG. 1. For the sake of brevity of the specification, the detailed description thereof will be omitted herein. It is noted that the advantage of the structure in FIG. 5 is that the left side of the inductor unit 5100 can add circles for enhancing the inductance when there is a need to increase the inductance of the inductor device 5000. Moreover, the right side of the inductor unit 5200 is still remain three circles to avoid the area of the inductor device 5000 being too large for occupying the space of the entire system.

Figure 6:
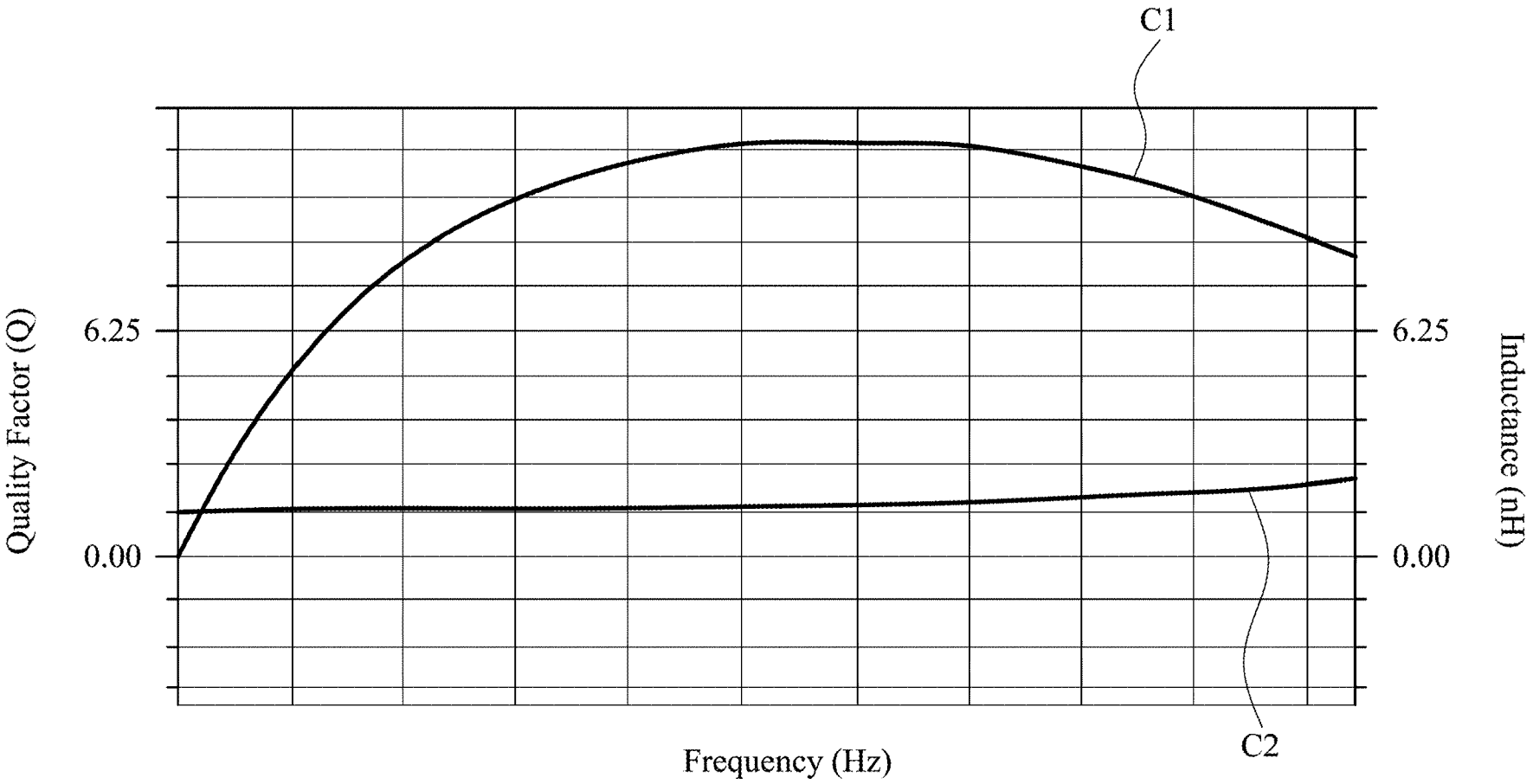
FIG. 6 depicts an experimental data diagram of an inductor device according to some embodiments of this disclosure.

FIG. 6 depicts an experimental data diagram of an inductor device according to some embodiments of this disclosure. The experimental data diagram is used for illustrating the quality factor (Q) and the inductance of the inductor device under different frequencies. As shown in figure, curve C1 shows verification data of the quality factor (Q) of the inductor device of the present disclosure, and curve C2 shows verification data of the inductance of the inductor device of the present disclosure. It is thus known from the experimental data shown in FIG. 6 that the quality factor of the inductor device is about 11, and the inductance of the inductor device is higher than 1 nH. As a result, it can be proved that since structures of two inductor units of the inductor device are symmetrical, the noise can be therefore decreased so as to enhance the efficiency of the inductor device. However, the present disclosure is not intended to be limited to the values described in the foregoing embodiment, those skilled in the art can adjust the foregoing values for achieving the best efficiency depending on actual requirements.

It is therefore understood from the embodiments of the present disclosure that the present disclosure has the following advantages. The present disclosure provides an inductor device. Since structures of two inductor units of the inductor device are symmetrical, the problem of performance of a conventional 8-shaped transformer being affected because the structure of the 8-shaped transformer is not symmetrical can be solved.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An inductor device, comprising:

a first inductor unit, comprising:

a first terminal and a second terminal respectively disposed at two opposite sides of the first inductor unit, wherein the first inductor unit comprises a first side and a second side located at two opposite sides of a first central connecting line, wherein the first central connecting line is between the first terminal and the second terminal;

a first wire winded to form a plurality of circles; and a second wire winded correspondingly to the first wire to form a plurality of circles, wherein the first wire and the second wire are winded in an interlaced manner at the first terminal and the second terminal respectively, wherein only the first wire is winded in an interlaced manner at the first side, wherein only the second wire is winded in an interlaced manner at the second side; and a second inductor unit, comprising:

a third terminal and a fourth terminal respectively disposed at two opposite sides of the second inductor unit, wherein the second inductor unit comprises a third side and a fourth side located at two opposite sides of a second central connecting line, wherein the second central connecting line is between the third terminal and the fourth terminal;

a third wire winded to form a plurality of circles; and a fourth wire winded correspondingly to the third wire to form a plurality of circles, wherein the third wire and/or the fourth wire are winded in an interlaced manner at the third terminal, the fourth terminal, the third side, and the fourth side respectively;

wherein the first wire of the first inductor unit is coupled to the fourth wire of the second inductor unit, and the second wire of the first inductor unit is coupled to the third wire of the second inductor unit.

2. The inductor device of claim 1, wherein the first wire and the second wire respectively comprise a first end and a second end, the first ends of the first wire and the second wire are located at the first terminal or the second terminal of the first inductor unit, and the second ends of the first wire and the second wire are located at the first terminal or the second terminal of the first inductor unit, wherein the third wire and the fourth wire respectively comprise a first end and a second end, the first ends of the third wire and the fourth wire are located at the third terminal or the fourth terminal of the second inductor unit, and the second ends of the third wire and the fourth wire are located at the third terminal or the fourth terminal of the second inductor unit.

3. The inductor device of claim 2, wherein the first inductor unit comprises a first circle, a second circle and a third circle, wherein the first wire is winded from the first end to the first side along the first circle and then winded in an interlaced manner into the second circle, next winded to the second terminal along the second circle and then winded in an interlaced manner into the third circle, wherein the first wire is winded to the first terminal along the third circle and then winded in an interlaced manner to the second circle, next winded to the first side along the second circle and then winded in an interlaced manner into the first circle.

4. The inductor device of claim 3, wherein the second wire is winded from the first terminal to the second side along the first circle and then winded in an interlaced manner into the second circle, next winded to the second terminal along the second circle and then winded in an interlaced manner into the third circle, wherein the second wire is winded to the first terminal along the third circle and then winded in an interlaced manner to the second circle, next winded to the second side along the second circle and then winded in an interlaced manner into the first circle.

5. The inductor device of claim 4, wherein the second inductor unit comprises a first circle, a second circle and a third circle, wherein the third wire is winded from the first end to the third side along the first circle and then winded in an interlaced manner into the second circle, next winded to the second terminal along the second circle and then winded in an interlaced manner into the third circle, wherein the third wire is winded to the first terminal along the third circle and then winded in an interlaced manner to the second circle, next winded to the third side along the second circle and winded in an interlaced manner into the first circle so as to couple to the second circle of the first inductor.

6. The inductor device of claim 5, wherein the fourth wire is winded from the first terminal to the fourth side along the first circle and then winded in an interlaced manner into the second circle, next winded to the second terminal along the second circle and then winded in an interlaced manner into the third circle, wherein the fourth wire is winded to the first terminal along the third circle and then winded in an interlaced manner to the second circle, next winded to the fourth side along the second circle and then winded in an interlaced manner into the first circle so as to couple to the first circle of the first inductor.

7. The inductor device of claim 6, wherein only the first wire is winded in an interlaced manner at the first side, the first wire is winded in an interlaced manner with the second wire at the first terminal and the second terminal, and only the second wire is winded in an interlaced manner at the second side, wherein only the third wire is winded in an interlaced manner at the third side, and the third wire is wined in an interlaced manner with the fourth wire at the third terminal and the fourth terminal, and only the fourth wire is winded in an interlaced manner at the fourth side.

8. The inductor device of claim 3, wherein the first circle, the second circle and the third circle are disposed from outside to inside in sequence.

9. The inductor device of claim 2, wherein the first inductor unit comprises a first circle, a second circle, a third wire and a fourth wire, wherein the first wire is winded from the first end to the second terminal along the first circle and then winded in an interlaced manner into the second circle, next winded to the second side along the second circle and then winded in an interlaced manner into the third circle, afterwards, winded to the first terminal along the third circle and then winded in an interlaced manner into the fourth circle, wherein the first wire is wined to the second terminal along the fourth wire and then winded in an interlaced manner into the third circle, next winded to the second side along the third circle and then winded in an interlaced manner into the second circle.

10. The inductor device of claim 9, wherein the second wire is winded from the first end to the second terminal along the first circle and then winded in an interlaced manner into the second circle, next winded to the first side along the second circle and then winded in an interlaced manner into the third circle, afterwards, winded to the first terminal along the third circle and then winded in an interlaced manner into the fourth circle, wherein the second wire is wined to the second terminal along the fourth wire and then winded in an interlaced manner into the third circle, afterwards, winded to the first side along the third circle and then winded in an interlaced manner into the second circle.

11. The inductor device of claim 10, wherein the second inductor unit comprises a first circle, a second circle, a third wire and a fourth wire, wherein the third wire is winded from the first end to the fourth terminal along the first circle and then winded in an interlaced manner into the second circle, next winded to the fourth side along the second circle and then winded in an interlaced manner into the third circle, afterwards, winded to the third terminal along the third circle and then winded in an interlaced manner into the fourth circle, wherein the third wire is wined to the fourth terminal along the fourth circle and then wined in an interlaced manner into the third circle, next winded to the fourth side along the third circle and then winded in an interlaced manner into the second circle.

12. The inductor device of claim 11, wherein the fourth wire is winded from the first end to the fourth terminal along the first circle and then winded in an interlaced manner into the second circle, next winded to the third side along the second circle and then winded in an interlaced manner into the third circle, afterwards, winded to the third terminal along the third circle and then winded in an interlaced manner into the fourth circle, wherein the fourth wire is wined to the fourth terminal along the fourth circle and then wined in an interlaced manner into the third circle, next winded to the third side along the third circle and then winded in an interlaced manner into the second circle.

13. The inductor device of claim 12, wherein the first wire is winded in an interlaced manner at the second side by itself, the first wire is winded in an interlaced manner with the second wire at the first terminal and the second terminal, and the second wire is winded in an interlaced manner at the first side by itself, wherein the third wire is winded in an interlaced manner at the fourth side by itself, the third wire is wined in an interlaced manner with the fourth wire at the third terminal and the fourth terminal, and the fourth wire is winded in an interlaced manner at the third side by itself.

14. The inductor device of claim 13, wherein the first end of the second wire is coupled to the first end of the third wire, and the first end of the first wire is coupled to the first end of the fourth wire in an interlaced manner at the first terminal and third terminal, wherein the first circle, the second circle, the third circle and the fourth circle are disposed from outside to inside in sequence.

15. The inductor device of claim 2, wherein the first inductor unit comprises a first circle, a second circle, a third wire and a fourth wire, wherein the first wire is winded from the first end to the second terminal along the first circle and then winded in an interlaced manner into the second circle, next winded to the second side along the second circle and then winded in an interlaced manner into the third circle, afterwards, winded to the first terminal along the third circle and then winded in an interlaced manner into the fourth circle, wherein the first wire is wined to the second terminal along the fourth circle an then wined in an interlaced manner into the third circle, next winded to the second side along the third circle and then winded in an interlaced manner into the second circle.

16. The inductor device of claim 15, wherein the second wire is winded from the first end to the second terminal along the first circle and then winded in an interlaced manner into the second circle, next winded to the first side along the second circle and then winded in an interlaced manner into the third circle, afterwards, winded to the first terminal along the third circle and then winded in an interlaced manner into the fourth circle, wherein the second wire is wined to the second terminal along the fourth circle and then wined in an interlaced manner into the third circle, next winded to the first side along the third circle and then winded in an interlaced manner into the second circle.

17. The inductor device of claim 16, wherein the second inductor unit comprises a first circle, a second circle and a third wire, wherein the third wire is winded from the first end to the third side along the first circle and then winded in an interlaced manner into the second circle, next winded to the fourth terminal along the second circle and then winded in an interlaced manner into the third circle, wherein the third wire is winded to the third terminal along the third circuit and then winded in an interlaced manner to the second circle, next winded to the third side along the second circle and then winded in an interlaced manner into the first circle.

18. The inductor device of claim 17, wherein the fourth wire is winded from the first terminal to the fourth side along the first circle and then winded in an interlaced manner into the second circle, next winded to the forth terminal along the second circle and then winded in an interlaced manner into the third circle, wherein the fourth wire is winded to the third terminal along the fourth circle and then winded in an interlaced manner to the second circle, next winded to the fourth side along the second circle and then winded in an interlaced manner into the first circle.

19. The inductor device of claim 18, wherein the first wire is winded in an interlaced manner at the second side by itself, the first wire is winded in an interlaced manner with the second wire at the first terminal and the second terminal, and the second wire is winded in an interlaced manner at the first side by itself, wherein the third wire is winded in an interlaced manner at the third side by itself, and the third wire is wined in an interlaced manner with the fourth wire at the third terminal and the fourth terminal, and the fourth wire is winded in an interlaced manner at the fourth side by itself.

20. The inductor device of claim 19, wherein the first end of the second wire is coupled to the first end of the third wire, and the first end of the first wire is coupled to the first end of the fourth wire in an interlaced manner at the first terminal and third terminal, wherein the first circle, the second circle, the third wire and the fourth wire are disposed from outside to inside in sequence.

* * * * *